US009844304B2

(12) United States Patent
McClendon

(10) Patent No.: US 9,844,304 B2
(45) Date of Patent: Dec. 19, 2017

(54) SOAP RECYCLING DEVICE AND METHOD OF OPERATION

(71) Applicant: Frederick McClendon, Brooklyn, FL (US)

(72) Inventor: Frederick McClendon, Brooklyn, FL (US)

( * ) Notice: Subject to any disclaimer, the term of this patent is extended or adjusted under 35 U.S.C. 154(b) by 854 days.

(21) Appl. No.: 14/169,279

(22) Filed: Jan. 31, 2014

(65) Prior Publication Data

US 2015/0216368 A1 Aug. 6, 2015

Related U.S. Application Data

(60) Provisional application No. 61/760,608, filed on Feb. 4, 2013.

(51) Int. Cl.
*A47K 5/12* (2006.01)
*C11D 13/16* (2006.01)
*C11D 13/30* (2006.01)

(52) U.S. Cl.
CPC ..... *A47K 5/1217* (2013.01); *C11D 13/16* (2013.01); *C11D 13/30* (2013.01)

(58) Field of Classification Search
CPC ..... C11D 15/00; C11D 13/00; C11D 13/16
USPC ..... 264/36.1, 36.18; 425/174.4
See application file for complete search history.

(56) References Cited

U.S. PATENT DOCUMENTS 5,368,387 A * 11/1994 Creighton ..... A47K 5/06 222/226
5,511,882 A * 4/1996 Anwunah ..... A47K 5/12 222/333
2005/0043196 A1* 2/2005 Wright ..... D06F 43/00 510/276
2005/0072449 A1* 4/2005 Alpert ..... A47L 15/0002 134/25.1
2011/0112001 A1* 5/2011 Seipler ..... C11D 13/30 510/152
2017/0145669 A1* 5/2017 Klicpera ..... E03C 1/00

* cited by examiner

*Primary Examiner* — Nahida Sultana
(74) *Attorney, Agent, or Firm* — H. John Rizvi; Gold & Rizvi, P.A.

(57) ABSTRACT

The invention refers to a soap recycling device that recycles solid soap bar remnants into purified liquid soap or purified reconstituted solid soap bars, depending on a user's selected mode of operation of the device. The soap recycling device includes a heat source that melts the solid soap remnants, a UV emitter that sterilizes the solid soap remnants, and a directional valve that selectively delivers the molten soap fluid to a first receptacle capable of storing the soap in liquid form and delivering it for direct usage, for instance for hand washing, and a second receptacle where the molten soap fluid solidifies and turns into a reconstituted solid soap bar. The device includes a user interface that allows selecting the desired operation mode to either liquid or solid soap formation. The device according to the invention is compact and versatile.

20 Claims, 8 Drawing Sheets

SOAP RECYCLING DEVICE AND METHOD OF OPERATION

CROSS-REFERENCE TO RELATED APPLICATIONS

This Non-Provisional Utility Patent Application claims the benefit of U.S. Provisional Patent Application Ser. No. 61/760,608, filed on Feb. 4, 2013, which is incorporated here in its entirety.

FIELD OF THE INVENTION

The present invention relates to a soap recycling device and method of operation of a soap recycling device that allow recycling remnant portions of soap bars, and in particular, to a soap recycling method and device that allow small leftover solid portions of soap to be either converted into sterilized, reconstituted solid soap, or into sterilized liquid soap.

BACKGROUND OF THE INVENTION

Soap is a chemical product that is used in a wide variety of applications. The main use of soap is for the washing of objects such as clothes, dishes, vehicles or practically any other object, the cleaning of floors, walls or practically any other surface, and the bathing of the human or animal body. Soap is also used in textile spinning or as a component of lubricants.

Soap's cleaning ability is provided mainly by certain components known as surfactants, which are both hydrophobic and hydrophilic. The hydrophobic part of the surfactant bonds with the dirtiness, while the hydrophilic part is attracted to water, causing the surfactant to link water and insoluble dirtiness, allowing dirtiness to be carried by water and thus eliminated from the object, surface or body to be cleaned. In addition, soap reduces the surface tension of water, increasing water's ability to make things wet.

Soap is a salt of a fatty acid. Soaps for cleansing are obtained by threating vegetable or animal oils with a strongly alkaline solution. Fats and oils are composed of triglycerides; three molecules of fatty acids are attached to a single molecule of glycerol. The alkaline solution, which is called lye, brings about a chemical reaction known as saponification. In saponification, the fats are first hydrolyzed into free fatty acids, which then combine with the alkali to form crude soap. Glycerol is liberated and is either left in or washed out and recovered as a useful byproduct, depending on the process employed.

Cleaning, washing or bathing soap is generally marketed in solid form or in liquid form. Solid formed soap can be presented in dust-like particles and in larger sized portions known as soap bars. Soap bars are normally used for hand washing of clothes and of the human or animal body, as they are easy to handle and friction against the surface to be cleaned. However, soap bars present the drawback of becoming virtually unusable once they have been used down to a small size that makes them difficult to handle. For this reason, soap bar remnants are discarded before they are entirely used.

Soap bars are used in households, in the industry, in commercial facilities such as hotels or spas, and in institutional establishments such as schools, hospitals and nursing homes, only to name a few. In these scenarios, a relatively large amount of money could be saved, and thus better invested in other enterprises, if soap bars were able to be used in their entirety.

Various attempts have been made to provide a soap bar recycling device that provides for reuse of soap bar remnants. Among these are found in U.S. Pat. No. 4,030,867 to Don D. Everman, U.S. Patent Application No. 2011/0127245 to Leon Burrus, and U.S. Pat. No. 5,968,390 to Stephen Lister. However, none of these attempts have successfully provided the market with cost-effective devices for recycling soap. In practice, households, commercial facilities, industrial facilities and institutional establishments continue to discard solid soap remnants and broken shards.

Accordingly, there remains a need in the art for a soap recycling device that successfully transforms used soap bar remnants into sterilized, reusable soap, and that is also able to be constructed into a relatively compact and affordable product that is suitable for both the consumer market and the business market.

SUMMARY OF THE INVENTION

The present invention overcomes the deficiencies of the known art and the problems that remain unsolved by providing a soap recycling device comprising a heat source and a UV emitter that respectively melt and sterilize solid soap remnants, and a directional valve that selectively delivers the molten soap fluid to a first receptacle capable of storing the soap in liquid form and delivering it for direct usage, for instance for hand washing, and a second receptacle where the molten soap fluid solidifies and turns into a reconstituted solid soap bar. The device includes a user interface that allows selecting the desired operation mode to either liquid or solid soap formation. The device according to the invention can be constructed in various shapes and sizes, including a counter-top, compact size that will make it most suitable for household environments allowing households to save money on soap. Businesses and institutions will also benefit from the device, whether it is in compact form or in a larger, non-compact form, as it will prevent indiscriminate waste of broken soap shards and provide significant economic savings. The device is also versatile, as it is capable of producing recycled soap in both liquid and solid format.

In accordance with one embodiment of the present invention, the invention consists of a soap recycling device comprising:

a housing, inside which a solid soap remnant receiving space is defined above a soap remnant receiving surface, wherein said receiving surface comprises a drainage opening;

at least one UV emitter arranged above said receiving space;

at least one heat source arranged to heat the receiving space;

a first receptacle, in downward fluid communication with the drainage opening;

a second receptacle, in downward fluid communication with the drainage opening;

a directional valve unit, operable to switch between a first position in which downward fluid communication from the drainage opening to the first receptacle is not blocked and downward fluid communication from the drainage opening to the second receptacle is blocked, and a second position in which downward fluid communication from the drainage opening to the first receptacle is blocked and downward fluid communication from the drainage opening to the second receptacle is not blocked;

a processor unit, comprising a storage memory storing computer executable instructions for operating the directional valve unit to switch between the first position and the second position.

In another aspect, the UV emitter comprises an array of UV-emitting LEDs.

In another aspect, the heat source comprises at least one heating coil arranged horizontally above the receiving space.

In another aspect, the UV emitter is arranged between the heating coil and the receiving space.

In a second aspect, the UV emitter is horizontally movable along the receiving space.

In another aspect, the housing comprises a main body and top cover assembly, wherein said heat source and said UV emitter are arranged inside said top cover assembly, and wherein the top cover assembly, the heat source and the UV emitter are jointly movable with respect to the main body from a closed position in which the heat source and the UV emitter are arranged on top of the receiving space, and an open position in which the heat source and the UV emitter are arranged separated from the receiving space and the receiving space is accessible from the outside allowing a user to place soap remnants in said receiving space.

In another aspect, the top cover assembly is hinged to the main body.

In another aspect, the housing comprises an open space arranged below the first receptacle, said open space being delimited by a top surface comprising a dispensing opening in fluid communication with the first receptacle.

In another aspect, the device further comprises a proximity sensor unit for detecting the presence of an object inside the open space, and a closure valve unit operable to switch between a closed position and an open position in which fluid communication between the first receptacle and the dispensing opening is respectively blocked and unblocked, the storage memory further storing computer executable instructions for operating the closure valve unit to switch between said closed position and said open position.

In another aspect, the second receptacle is accessible from outside the housing.

In another aspect, the device further comprises at least one cavity tray sized to fit inside the second receptacle, said cavity tray comprising at least one cavity for the formation of a soap bar.

In another aspect, the device further comprises a user interface, wherein the processor unit is responsive to user operation of the user interface and operates the direction valve to switch in dependency of user operation of the user interface.

Introducing another embodiment of the present invention, the invention consists of a soap recycling device comprising:

a housing, inside which a solid soap remnant receiving space is defined above a soap remnant receiving surface, wherein said receiving surface comprises a drainage opening;

at least one heat source arranged above the receiving space, for heating the receiving space;

at least one UV emitter arranged above said receiving space and beneath said heat source, said UV emitter being horizontally movable along the receiving space;

a first receptacle, in downward fluid communication with the drainage opening;

a second receptacle, in downward fluid communication with the drainage opening;

a directional valve unit, operable to switch between a first position in which downward fluid communication from the drainage opening to the first receptacle is not blocked and downward fluid communication from the drainage opening to the second receptacle is blocked, and a second position in which downward fluid communication from the drainage opening to the first receptacle is blocked and downward fluid communication from the drainage opening to the second receptacle is not blocked;

a processor unit, comprising a storage memory storing computer executable instructions for operating the directional valve unit to switch between the first position and the second position.

In a second aspect, the housing comprises a main body and top cover assembly, wherein said heat source and said UV emitter are arranged inside said top cover assembly, and wherein the top cover assembly, the heat source and the UV emitter are jointly movable with respect to the main body from a closed position in which the heat source and the UV emitter are arranged on top of the receiving space, and an open position in which the heat source and the UV emitter are arranged separated from the receiving space and the receiving space is accessible from the outside allowing a user to place soap remnants in said receiving space.

In another aspect, the top cover assembly is hinged to the main body.

Introducing yet another embodiment of the present invention, the invention consists of a method of operation of a soap recycling device comprising a housing inside which a soap remnant receiving space is defined above a soap remnant receiving surface provided with a drainage opening, said method being performed by a processor unit comprised in the device, the method comprising the steps of:

a) detecting a user command from a user interface;

b) switching at least one heat source to an activated state in which the heat source heats the receiving space;

c) switching at least one UV emitter arranged above said receiving space to an activated state in which the UV emitter emits UV radiation towards the receiving space;

d) selectively operating a directional valve to provide downward fluid communication between the drainage opening and either a first receptacle or a second receptacle, in dependence of the user command.

In a second aspect, the method comprises the step of switching a UV emitter arranged above said receiving space to an activated state in which the UV emitter emits UV radiation towards the receiving space, and in which the UV emitter moves horizontally along said receiving space.

In another aspect, the method further comprises the step of dispensing liquid soap from the first receptacle, through a dispensing opening, to an open space arranged below the first receptacle.

In another aspect, the method further comprises the step of sensing the proximity of an object inside the open space, and selectively operating a closure valve unit to switch between a closed position and an open position in which fluid communication between the first receptacle and the dispensing opening is respectively blocked and unblocked.

In another aspect, the method further comprises the steps of measuring the time elapsed since the directional valve unit has switched to the second position, in which downward fluid communication from the drainage opening to the first receptacle is blocked and downward fluid communication from the drainage opening to the second receptacle is not blocked, and providing a sensory indication to a user through the user interface upon expiration of a predetermined amount of time.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
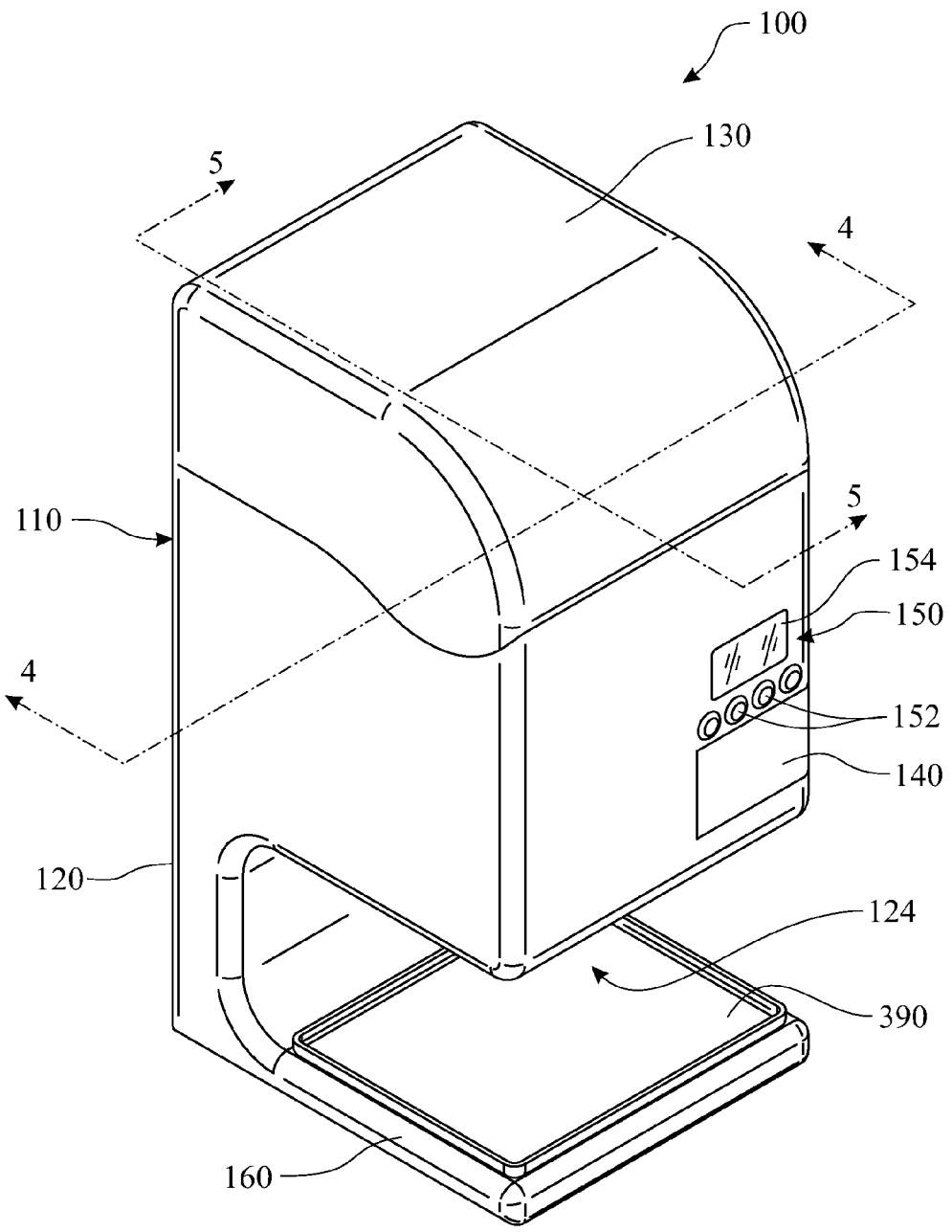
FIG. 1 presents a first perspective view of an exemplary embodiment of a soap recycling device according to the invention, shown in a position in which a cover assembly included in the device is closed.

The illustration of FIG. 1 shows a general perspective view of an exemplary embodiment of the invention, consisting of a soap recycling device 100 comprised of a compact, sleek housing 110 inside of which most of the soap recycling components are comprised. The housing 110 is essentially formed by a main body 120 and a cover assembly 130, generally manufactured of a thermoplastic material. An open space 124 is delimited in the lower portion of the main body 120, wherein the device 100 is able to deliver sterilized liquid soap formed out of solid soap remnants, as will be explained, at the open space 124. A removable cavity tray 140 is also included in a front portion of the device 100. Reconstituted, sterilized soap bars are formed inside the cavity tray 140 from solid soap remnants, as will also be explained. The device 100 further includes a user interface 150 accessible to a user at a front area of the housing 110. In the embodiment shown, the user interface 150 includes a set of push buttons 152 and a small display 154. However, a person skilled in the art will understand that the user interface can present many different embodiments that allow communicating a person with an electronic device, such as tactile screen, a voice recognition module, a sound recognition module, or the like. The user interface could also be external to the device 100, such as a remote control or a separate device in wireless or wired communication with the device 100. In addition, a cover assembly 130 is included in the upper portion of the housing 110. The device 100 stands on a base portion 160, above which the open space 124 is arranged.

Figure 2:
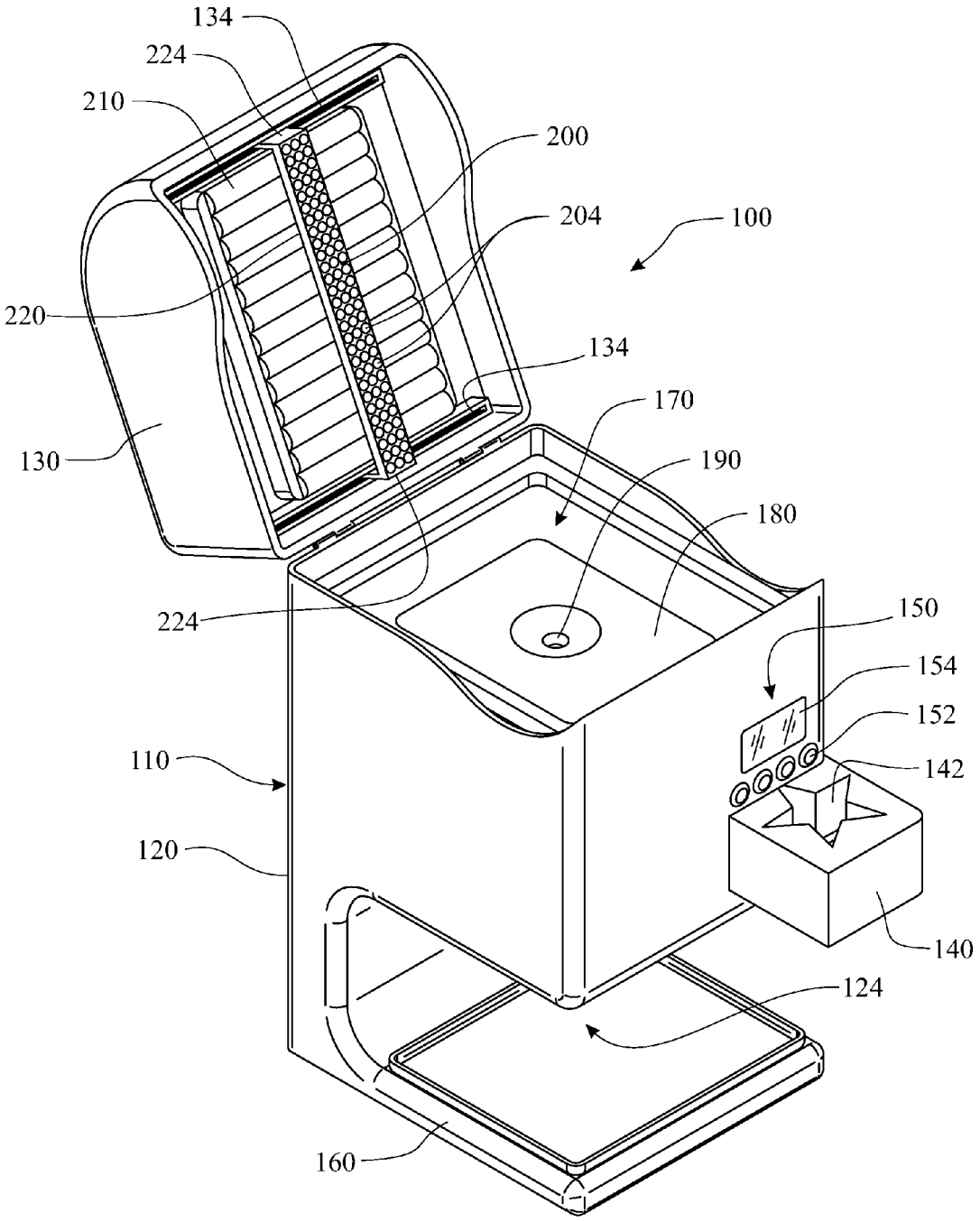
FIG. 2 presents the device of FIG. 1, shown in a different position, in which a cavity tray is extracted and in which the cover assembly is open, unveiling a soap remnant receiving surface.

The illustration of FIG. 2 shows the device 100 in a second position in which the cover assembly 130 has been opened to reveal certain inner components of the device 100. In the present embodiment, the cover assembly 130 is hinged to the housing 110, so that it can be easily opened or closed without the risk of losing or dropping the cover assembly 130. The cover assembly 130 can further include a snap-locking system. As shown in the figure, the device 100 further comprises a solid soap remnant receiving space 170 inside which a user will place solid soap remnants for recycling. The receiving space 170 is defined above a soap remnant receiving surface 180, which is precisely where the user will rest and pile the solid soap remnants until appropriately filling the receiving space 170. The receiving surface 180 comprises a drainage opening 190 and is preferably slightly tilted towards the drainage opening 190 to favor fluid drainage therethrough.

The device 100 further includes at least one UV emitter 200 arranged above the receiving space 170, capable of emitting UV radiation that destroys bacteria and viruses, disinfecting solid soap remnants placed in the receiving space 170. In the embodiment shown, the UV emitter 200 is an array of UV-emitting LEDs 204 oriented towards the receiving space 170 when the cover assembly 130 is closed as shown in FIG. 1 and the device 100 is in operating condition. In addition, the device 100 includes at least one heat source 210 configured to heat the receiving space 170 and cause the solid soap remnants to melt into liquid form. In the present embodiment, the heat source 210 is a heating coil that is horizontally arranged over the receiving space 170 when the cover assembly 130 is closed as shown in FIG. 1 and the device 100 is in operating condition. In addition, in the present embodiment the UV emitter 200 is arranged between the heating coil heat source 210 and the receiving space 170. Having a coil heat source 210 arranged on top of a UV emitter 200 that is, in turn, above the solid soap remnant receiving space 170, where the coil heat source 210 is horizontally arranged over the receiving space 170 when the cover assembly 130 is closed, provides a very compact and effective final construction of the device 100, as can be appreciated in FIGS. 1 and 2.

Preferably, the UV emitter 200 is horizontally movable along the receiving space 170 when the cover assembly 130 is closed as shown in FIG. 1 and the device 100 is in operating condition. For instance, in the present embodiment, the array of UV-emitting LEDs 204 is supported on a structure 220 including opposite end walls 224 that glide along respective guide channels 134 formed in the cover assembly 130. Having a horizontally movable UV emitter 200 allows to homogeneously disinfect the solid soap remnants and melted liquid soap present throughout the entire receiving space 170.

In other words, in the present embodiment, the UV emitter 200 and the heat source 210 are arranged inside the top cover assembly 130. The UV emitter 200, the heat source 210 and the top cover assembly 130 are jointly movable with respect to the main body 120 from a closed position in which the UV emitter 200 and the heat source 210 are arranged on top of the receiving space 170, and an open position in which the UV emitter 200 and the heat source 210 are arranged separated from the receiving space 170 so that the receiving space 170 is accessible from the outside allowing a user to place soap remnants in said receiving space 170. Such an arrangement of the UV emitter 200 and the heat source 210 inside the cover assembly 130 contributes to reduce the total volume of the device 100.

Figure 4:
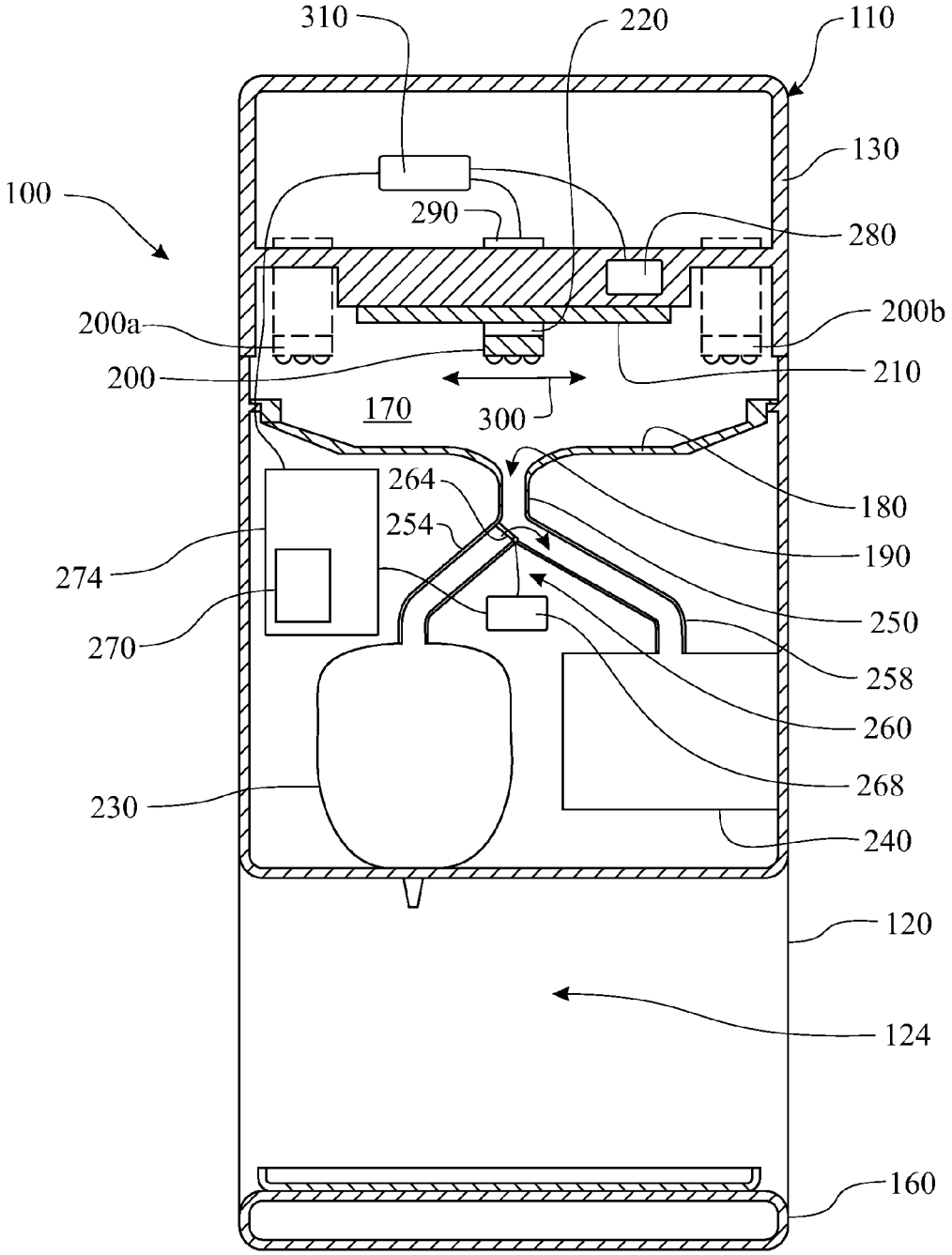
FIG. 4 presents a schematic cross-sectional view of the device the previous figures, according to cross-sectional plane 4-4 indicated in FIG. 1.

The cross-sectional view of FIG. 4 allows to observe internal components of the device 100. As shown, the device 100 further comprises a first receptacle 230 and a second receptacle 240. Both the first receptacle 230 and the second receptacle 240 are in downward fluid communication with the drainage opening 190 through an inverted Y-shaped tubing structure composed of a common drainage tube 250, a first branch tube 254 and a second branch tube 258. In addition, the device 100 comprises a directional valve unit 260 comprised of a directional valve 264 (schematically illustrated as a switch) and a directional valve sensor 268. The directional valve unit 260 is operable to switch between a first position in which the directional valve 264 blocks any downward fluid communication from the drainage opening 190 to the second receptacle 240 and allows downward fluid communication from the drainage opening 190 to the first receptacle 230, and a second position in which the directional valve 264 allows downward fluid communication from the drainage opening 190 to the second receptacle 240 and blocks any downward fluid communication from the drainage opening 190 to the first receptacle 230. The directional valve unit 260 is shown in the figure in the second position, i.e., in the position in which fluid would flow from the drainage opening 190 to the second receptacle 240. The directional valve sensor 268 allows the position of the directional valve 264 to be controlled and varied by a commanding processor unit 270. The processor unit 270 is normally located on a printed circuit board 274. The processor unit 270 includes storage memory in which computer executable instructions, i.e., instructions that are executable by the processor unit 270, are stored for operating the directional valve unit 260 to switch between the aforementioned first and second positions.

In a preferred embodiment, the processor unit 270 is responsive to user operation of the user interface 150 and operates the directional valve 264 to switch from one position to another in dependency of user operation of the user interface 150. Therefore, the user can select whether soap remnants are to be recycled into disinfected liquid form or into disinfected, reconstituted solid soap bars.

The illustration of FIG. 4 also depicts the internal components in charge of controlling and operating UV emitter 200 and heat source 210. Specifically, the device 100 includes a heating coil controller 280 for activating and deactivating the coil heat source 210, i.e., for allowing or preventing an electric current flow through the coil heat source 210. The device 100 also includes a UV emitter motor 290 for causing a horizontal movement of the UV emitter 200 along the receiving space 170. Horizontal movement is indicated by arrow 300 and by having represented the UV emitter 200 in a first extreme position **200*a* and a second extreme position 200*b*, shown in dashed lines. A UV and heating controller 310 is also included for controlling and causing operation of the UV emitter motor 290 and the heating coil controller 280 as commanded by the processor unit 270**.

Figure 5:
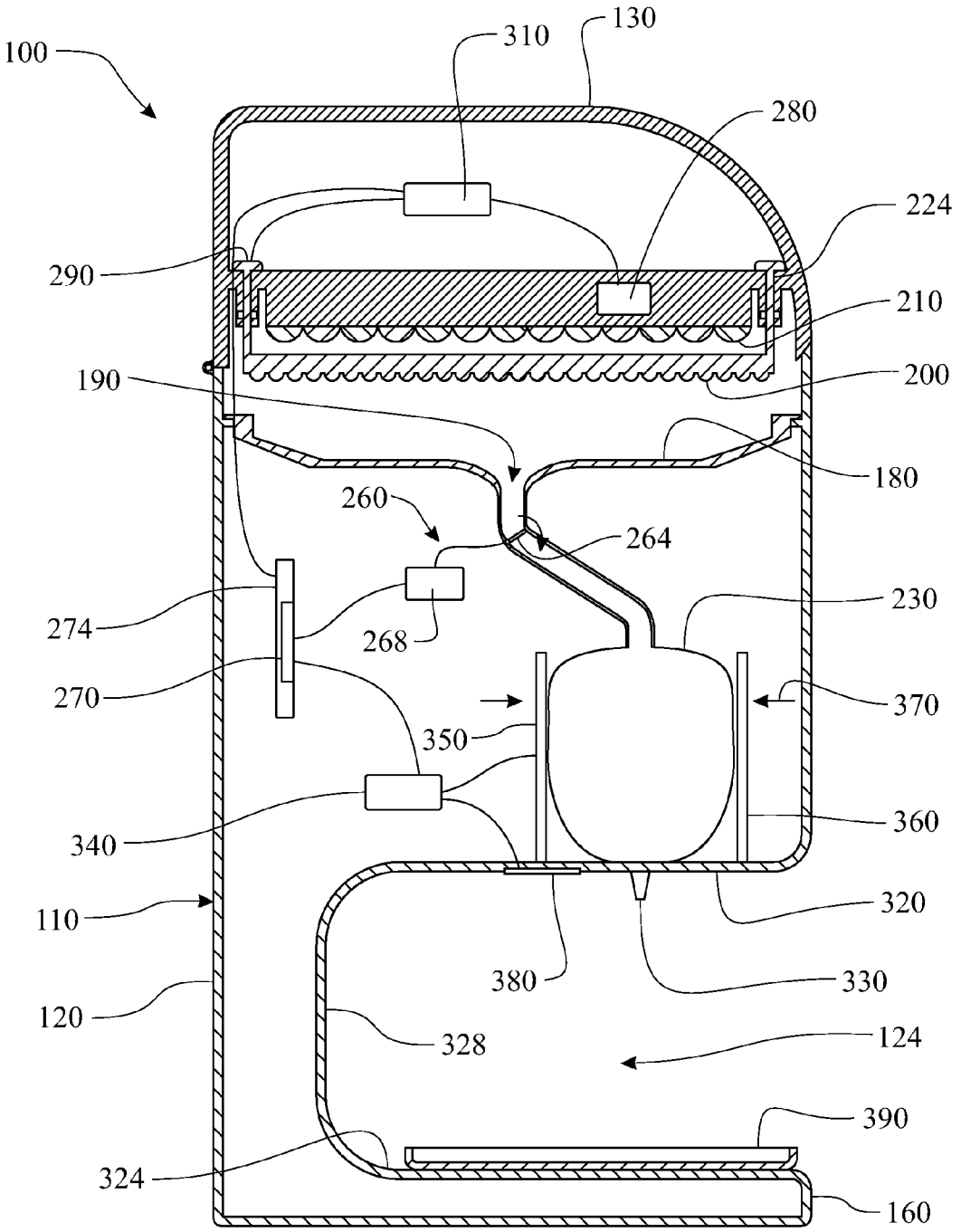
FIG. 5 presents a schematic cross-sectional view of the device the previous figures, according to cross-sectional plane 5-5 indicated in FIG. 1.

The open space 124 of the present embodiment is arranged below the first receptacle 230, as best shown in FIG. 5. Said open space 124 is delimited by a top surface 320, a bottom surface 324 and at least one side wall 328—one side wall 328, in the embodiment shown in the figures-. A dispensing nozzle or opening 330 is arranged on the top surface 320, in fluid communication with the first receptacle 230, in order to allow fluid soap to be delivered from the first receptacle 230 to the open space 124. The device 100 further includes a fluid soap dispenser controller 340 which activates and deactivates a motor (not shown) in charge of moving two pressing elements 350, 360, such as two movable walls, in an inward direction as indicated by arrows 370, in order to exert a pressure on the first receptacle 230 and cause fluid soap to be expelled through the dispensing opening 330. The fluid soap dispenser controller 340 is again communicated with the processor unit 270, which controls the operation of the fluid soap dispenser controller 340.

Figure 3:
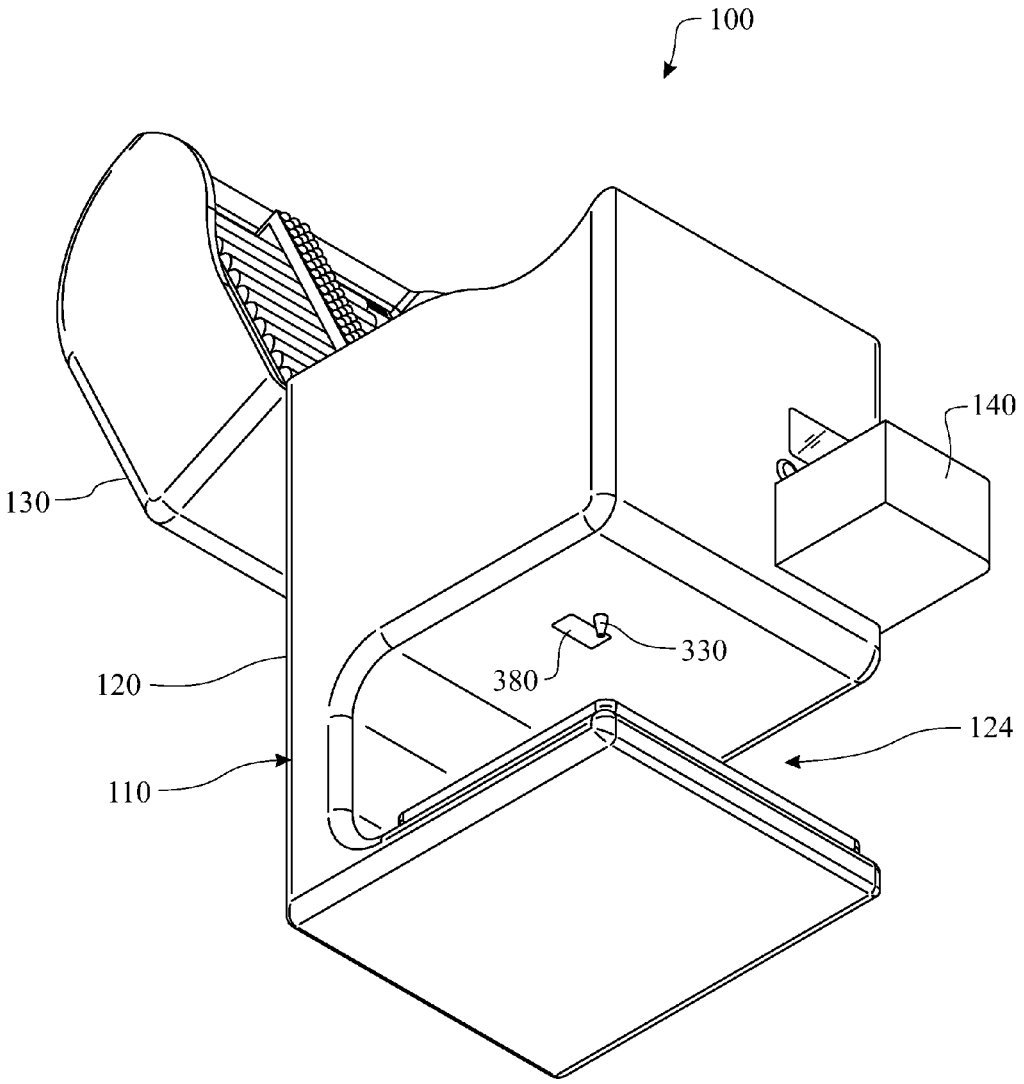
FIG. 3 presents the device of FIG. 2 shown from a lower angle in order to reveal a top surface of an open space included in the bottom area of the device, and a proximity sensor unit arranged on the top surface.

As shown in FIGS. 3 and 5, the device 100 can further comprise a proximity sensor unit 380 for detecting the presence of an object inside the open space 124, and a closure valve unit (not shown) operable to switch between a closed position and an open position in which fluid communication between the first receptacle 230 and the dispensing opening 330 is respectively blocked and unblocked. A person skilled in the art will understand that the closure valve unit can be a separate element or can be integrated in the dispensing opening 330, for instance by the closure valve consisting of a contractible and expandable mechanism integrated in the dispensing opening 330. Having a proximity sensor unit 380 arranged next to the open space 124 allows the device 100 to be used as an automatic liquid soap dispenser from which a user can directly dispense soap onto his or her hands by simply inserting the hands inside the open space 124. The device 100 can further include a removable tray 390 shaped and sized to fit on the bottom surface 324, and to collect any liquid soap that might drip from the dispensing opening 330.

Figure 6:
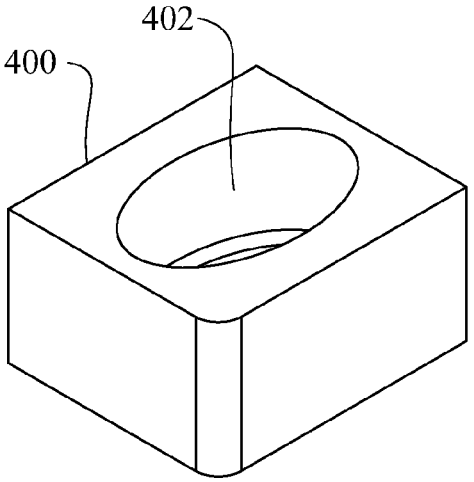
FIG. 6 presents a second exemplary embodiment of a cavity tray.
Figure 7:
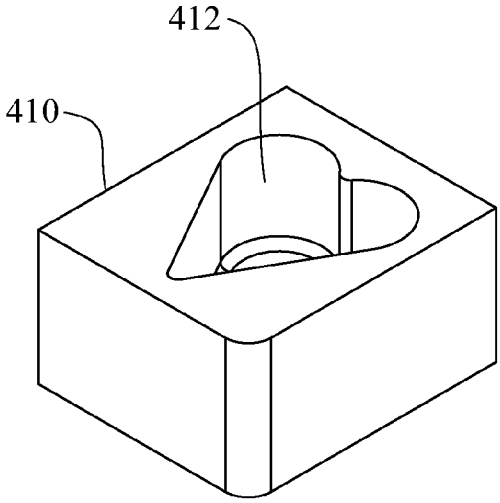
FIG. 7 presents a third exemplary embodiment of a cavity tray.
Figure 8:
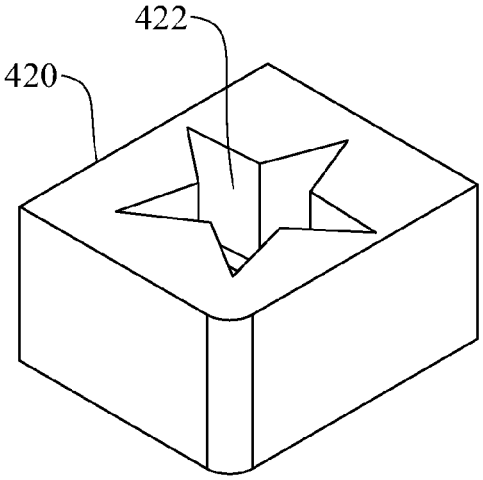
FIG. 8 presents a fourth exemplary embodiment of a cavity tray.

In the present embodiment, the second receptacle 240 is accessible from outside the housing 110, to allow a user to easily collect reconstituted solid soap bars formed inside the second receptacle 240. The device 100 preferably also comprises at least one cavity tray sized to fit inside the second receptacle 240. For instance, as has been mentioned, the illustrations of FIGS. 1 and 2 show a first exemplary cavity tray 140 respectively inserted into and pulled out from the second receptacle 240. The illustrations of FIGS. 6, 7 and 8 show alternative embodiments of cavity trays 400, 410, 420. All cavity trays 140, 400, 410, 420 are externally sized and shaped to easily but snugly fit into the second receptacle 240, and include differently-shaped inner cavities 142, 402, 412, 422 for the formation of differently-shaped reconstituted solid soap bars.

Figure 9:
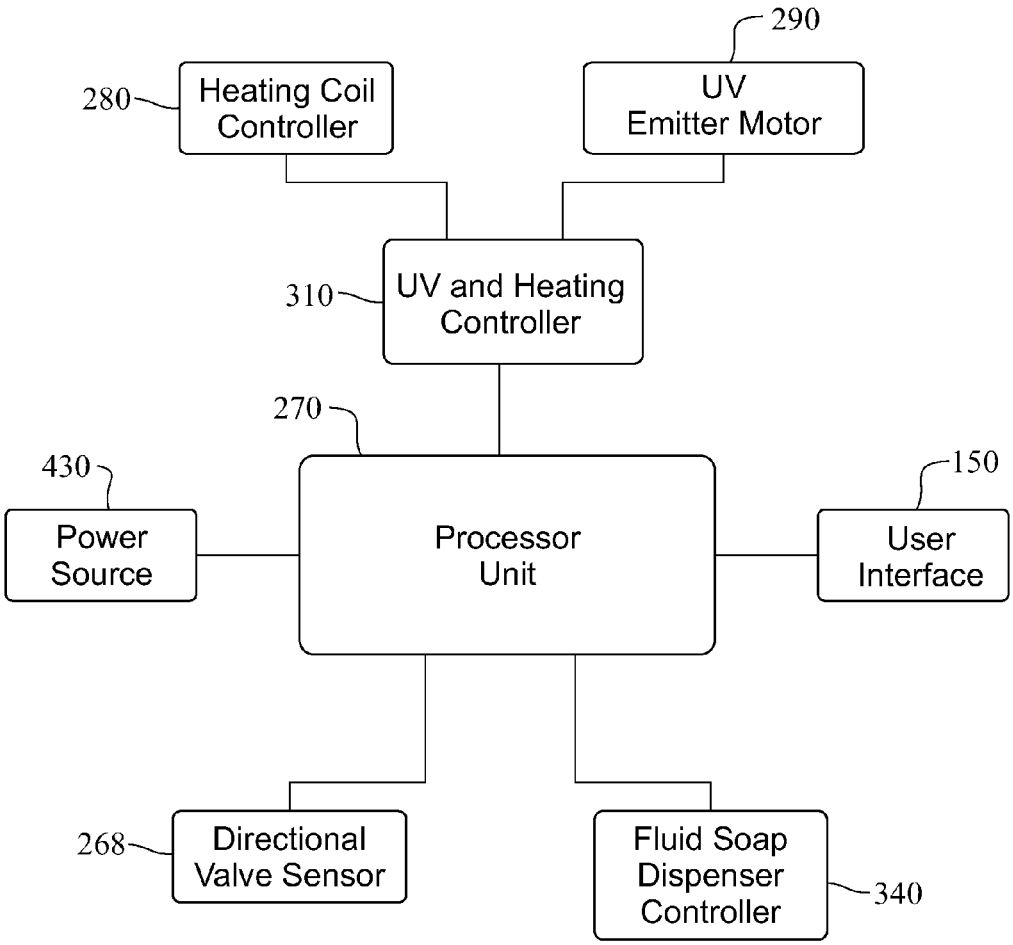
FIG. 9 presents a block diagram of the device of FIG. 1.
Figure 10:
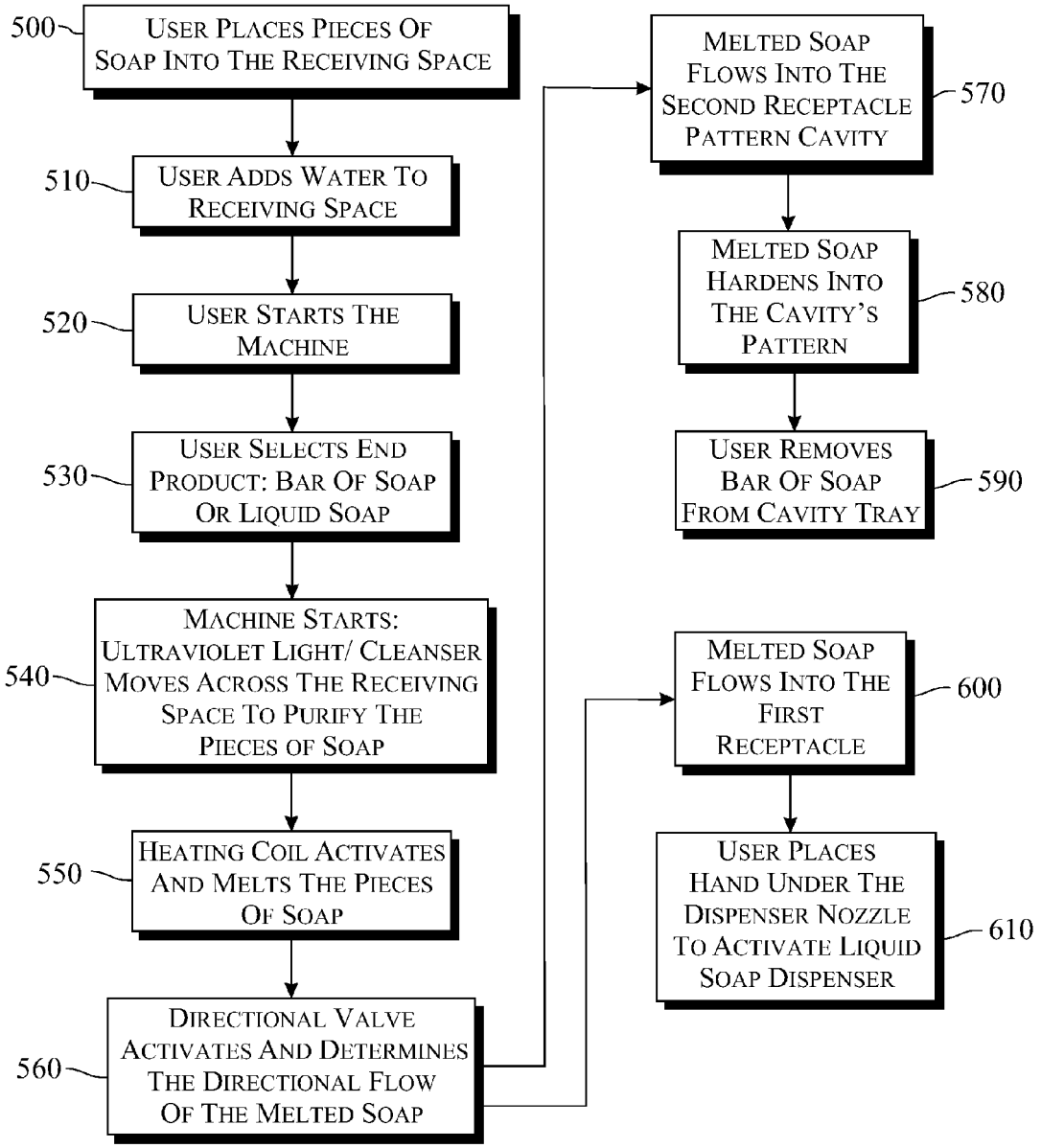
FIG. 10 presents a flow chart of an embodiment of the method for recycling soap according to the invention.

A block diagram is shown in FIG. 9 representing the processor unit 270 centrally controlling the operation of the heating coil controller 280, the UV emitter motor 290, the UV and heating controller 310, the directional valve sensor 268 and the fluid soap dispenser controller 340, in dependency of user commands received from the user interface 150. A power source 430 provides electrical power to the processor unit 270 and all other electric components comprised in the device 100.

The flow chart of FIG. 8 allows to understand the method of operation of the device 100 of the present embodiment. A user willing to recycle solid soap remnant pieces begins by opening the cover assembly 130 and placing the pieces of soap in the receiving space 170, as indicated in step 500. The user then optionally adds water to the soap remnant pieces, as indicated in step 510. Scents and/or disinfecting, antibacterial agents can be incorporated as well. The user then closes the cover assembly 130 and starts the device 100, for instance by pressing an ON/OFF push button 152 of the user interface 150, as indicated in step 520. The user selects whether the solid soap remnants are to be recycled into liquid soap or solid soap bars, as indicated in step 530, for instance by pressing one of two respective "LIQUID SOAP" and "SOAP BAR" push buttons 152 of the user interface 150. Steps 520, 530 can be performed in any given order. The processor unit 270 detects the user command originated in the user interface 150, associated to the selected final product form (liquid or solid). The processor unit 270 then switches the UV emitter 200 arranged above said receiving space 170 to an activated state in which it emits UV radiation towards the receiving space 170 in order to purify the soap pieces, and in which it preferably moves horizontally across the receiving space 170, as indicated in step 540. The processor unit 270 also switches the heat source 210 to an activated state, as indicated in step 550, in which it heats the receiving space 170 in order to melt the solid soap remnant pieces. In addition, as shown in step 560, the processor unit 270 operates the directional valve 264 to provide downward fluid communication between the drainage opening 190 and either the first receptacle 230 or the second receptacle 240, in dependence of the specific user command received from the user interface 150. For instance, in the event of receiving a "SOAP BAR" command, the processor unit 270 switches the directional valve 264 to provide fluid communication from the drainage opening 190 to the second receptacle 240; in consequence, melted soap flows from the receiving space 170 down to the second receptacle 240 and into the cavity 142, 402, 412, 422 of a cavity tray 140, 400, 410, 420 placed inside the second receptacle 240, as indicated in step 570. The melted soap is allowed to solidify into the pattern of the cavity 142, 402, 412, 422 as indicated in step 580. The user eventually pulls the cavity tray 140, 400, 410, 420 out and, as indicated in step 590, removes the reconstituted soap bar from the cavity tray. If, however, the processor unit 270 receives a "LIQUID SOAP" command, the processor unit 270 switches the directional valve 264 to provide fluid communication from the drainage opening 190 to the first receptacle 230; in consequence, melted soap flows from the receiving space 170 down to the first receptacle 230, as indicated in step 600. The first receptacle 230 therefore becomes partially or fully loaded with liquid soap. The user then places his or her hands inside the open space 124, as indicated in step 610, and the proximity sensor unit 380 detects the presence of the hands and thus signals, via the fluid soap dispenser controller 340, the processor unit 270 to operate the fluid soap dispenser controller 340 to open the dispensing opening 330 and activate liquid soap dispensing on the user's hands.

The method can further comprise the steps of measuring the time elapsed since the directional valve unit 260 has switched to the second position, in which downward fluid communication from the drainage opening 190 to the first receptacle 230 is blocked and downward fluid communication from the drainage opening 190 to the second receptacle 240 is not blocked, and providing a sensory indication to a user through the user interface 150 upon expiration of a predetermined amount of time. For instance, the sensory indication can consist of a visual indication on the display 154 and an audible beeping sound. The device 100 is thus able to inform the user when a solid soap bar has finished hardening inside the cavity and is ready to be removed by the user.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A soap recycling device comprising:

a housing, inside which a solid soap remnant receiving space is defined above a soap remnant receiving surface, wherein said receiving surface comprises a drainage opening;

at least one UV emitter arranged above said receiving space;

at least one heat source arranged to heat the receiving space;

a first receptacle, in downward fluid communication with the drainage opening;

a second receptacle, in downward fluid communication with the drainage opening;

a directional valve unit, operable to switch between a first position in which downward fluid communication from the drainage opening to the first receptacle is not blocked and downward fluid communication from the drainage opening to the second receptacle is blocked, and a second position in which downward fluid communication from the drainage opening to the first receptacle is blocked and downward fluid communication from the drainage opening to the second receptacle is not blocked;

a processor unit, comprising a storage memory storing computer executable instructions for operating the directional valve unit to switch between the first position and the second position.

2. The device of claim 1, wherein the at least one UV emitter comprises an array of UV-emitting LEDs.

3. The device of claim 1, wherein the at least one heat source comprises at least one heating coil arranged horizontally above the receiving space.

4. The device of claim 1, wherein the at least one UV emitter is arranged between the heating coil and the receiving space.

5. The device of claim 4, wherein the at least one UV emitter is horizontally movable along the receiving space.

6. The device of claim 1, wherein the housing comprises a main body and a top cover assembly, wherein said at least one heat source and said at least one UV emitter are arranged inside said top cover assembly, and wherein the top cover assembly, the at least one heat source and the at least one UV emitter are jointly movable with respect to the main body from a closed position in which the at least one heat source and the at least one UV emitter are arranged on top of the receiving space, and an open position in which the at least one heat source and the at least one UV emitter are arranged separated from the receiving space and the receiving space is accessible from the outside allowing a user to place soap remnants in said receiving space.

7. The device of claim 6, wherein the top cover assembly is hinged to the main body.

8. The device of claim 1, wherein the housing comprises an open space arranged below the first receptacle, said open space being delimited by a top surface comprising a dispensing opening in fluid communication with the first receptacle.

9. The device of claim 1, further comprising a proximity sensor unit for detecting the presence of an object inside the open space, and a closure valve unit operable to switch between a closed position and an open position in which fluid communication between the first receptacle and the dispensing opening is respectively blocked and unblocked, the storage memory further storing computer executable instructions for operating the closure valve unit to switch between said closed position and said open position.

10. The device of claim 1, wherein the second receptacle is accessible from outside the housing.

11. The device of claim 10, wherein the device further comprises at least one cavity tray sized to fit inside the second receptacle, said at least one cavity tray comprising at least one cavity for the formation of a soap bar.

12. The device of claim 1, wherein the device further comprises a user interface, wherein the processor unit is responsive to user operation of the user interface and operates the direction valve to switch in dependency of user operation of the user interface.

13. A soap recycling device comprising:

a housing, inside which a solid soap remnant receiving space is defined above a soap remnant receiving surface, wherein said receiving surface comprises a drainage opening;

at least one heat source arranged above the receiving space, for heating the receiving space;

at least one UV emitter arranged above said receiving space and beneath said at least one heat source, said at least one UV emitter being horizontally movable along the receiving space;

a first receptacle, in downward fluid communication with the drainage opening;

a second receptacle, in downward fluid communication with the drainage opening;

a directional valve unit, operable to switch between a first position in which downward fluid communication from the drainage opening to the first receptacle is not blocked and downward fluid communication from the drainage opening to the second receptacle is blocked, and a second position in which downward fluid communication from the drainage opening to the first receptacle is blocked and downward fluid communication from the drainage opening to the second receptacle is not blocked;

a processor unit, comprising a storage memory storing computer executable instructions for operating the directional valve unit to switch between the first position and the second position.

14. The device of claim 13, wherein the housing comprises a main body and top cover assembly, wherein said at least one heat source and said at least one UV emitter are arranged inside said top cover assembly, and wherein the top cover assembly, the at least one heat source and the at least one UV emitter are jointly movable with respect to the main body from a closed position in which the at least one heat source and the at least one UV emitter are arranged on top of the receiving space, and an open position in which the at least one heat source and the at least one UV emitter are arranged separated from the receiving space and the receiving space is accessible from the outside allowing a user to place soap remnants in said receiving space.

15. The device of claim 14, wherein the top cover assembly is hinged to the main body.

16. A method of operation of a soap recycling device, the soap recycling device comprising:

a housing, inside which a solid soap remnant receiving space is defined above a soap remnant receiving surface, wherein said receiving surface comprises a drainage opening;

at least one UV emitter arranged above said receiving space;

at least one heat source arranged to heat the receiving space;

a first receptacle, in downward fluid communication with the drainage opening;

a second receptacle, in downward fluid communication with the drainage opening;

a directional valve unit;

a processor unit, comprising a storage memory storing computer executable instructions for operating the directional valve unit to switch between the first position and the second position; and a user interface;

the method comprising the steps of:

a) detecting a user command from the user interface;

b) switching the at least one heat source to an activated state in which the at least one heat source heats the receiving space;

c) switching the at least one UV emitter to an activated state in which the at least one UV emitter emits UV radiation towards the receiving space;

d) selectively operating the directional valve to switch between a first position in which downward fluid communication from the drainage opening to the first receptacle is not blocked and downward fluid communication from the drainage opening to the second receptacle is blocked, and a second position in which downward fluid communication from the drainage opening to the first receptacle is blocked and downward fluid communication from the drainage opening to the second receptacle is not blocked, in dependence of the user command.

17. The method of claim 16, further comprising a step of moving the at least one UV emitter in the activated state horizontally along said receiving space.

18. The method of claim 16, further comprising the step of dispensing liquid soap from the first receptacle, through a dispensing opening, to an open space arranged below the first receptacle.

19. The method of claim 16, further comprising the step of sensing the proximity of an object inside the open space, and selectively operating a closure valve unit to switch between a closed position and an open position in which fluid communication between the first receptacle and the dispensing opening is respectively blocked and unblocked.

20. The method of claim 16, further comprising the steps of measuring the time elapsed since the directional valve unit has switched to the second position, in which downward fluid communication from the drainage opening to the first receptacle is blocked and downward fluid communication from the drainage opening to the second receptacle is not blocked, and providing a sensory indication to a user through the user interface upon expiration of a predetermined amount of time.

* * * * *